US006929597B2

(12) United States Patent
Hampe

(10) Patent No.: US 6,929,597 B2
(45) Date of Patent: Aug. 16, 2005

(54) CLOSING DEVICE FOR A FLAP ON AN INCUBATOR HOOD

(75) Inventor: Markus Hampe, Lübeck (DE)

(73) Assignee: Dräger Medical AG & Co., KGaA, Lübeck (DE)

( * ) Notice: Subject to any disclaimer, the term of this patent is extended or adjusted under 35 U.S.C. 154(b) by 0 days.

(21) Appl. No.: 10/842,133

(22) Filed: May 10, 2004

(65) Prior Publication Data

US 2005/0020872 A1 Jan. 27, 2005

(30) Foreign Application Priority Data

Jul. 22, 2003 (DE) ..... 103 33 175

(51) Int. Cl.[7] ..... A61G 11/00
(52) U.S. Cl. ..... 600/22
(58) Field of Search ..... 600/21, 22; 128/205, 128/26; 220/326; 49/307–315

(56) References Cited

U.S. PATENT DOCUMENTS 1,989,487 A * 1/1935 McCormick ..... 126/194
4,850,464 A * 7/1989 Doller et al. ..... 192/45
5,112,293 A * 5/1992 Vaccaro ..... 600/22
5,817,004 A * 10/1998 Koch ..... 600/22
6,592,511 B2 * 7/2003 Honma et al. ..... 600/22
2004/0201227 A1 * 10/2004 Smith ..... 292/241

* cited by examiner

*Primary Examiner*—Samuel G. Gilbert
(74) *Attorney, Agent, or Firm*—McGlew and Tuttle, P.C.

(57) ABSTRACT

A closing device for a flap on an incubator hood or thermotherapy apparatus hood is equipped with flaps, which make access possible to the premature or newborn baby from the outside. A closing device for the flap (1) on an thermotherapy apparatus hood (3) is provided which guarantees reliable closing. A roller (9) at a second closing element (5) extends behind a first closing element (4). The roller (9) is mounted on an axle (8) with a clearance in a range of 1.5 mm to 2.0 mm in a direction perpendicular to the direction in which the axle (8) extends, so that an undefined state of the closing device, in which the roller (9), though touching the first closing element (4), does not extend behind it, is avoided.

21 Claims, 3 Drawing Sheets

CLOSING DEVICE FOR A FLAP ON AN INCUBATOR HOOD

CROSS REFERENCE TO RELATED APPLICATIONS

This application claims the benefit of priority under 35 U.S.C. § 119 of German patent application DE 103 33 175.1 filed Jul. 22, 2003 the entire contents of which are incorporated herein by reference.

FIELD OF THE INVENTION

The present invention pertains to a closing device for a flap on an incubator hood.

BACKGROUND OF THE INVENTION

Incubator hoods on incubators or generally on thermotherapy apparatus for premature or newborn babies are usually equipped with flaps, which make it possible to open the incubator hood and to have access to the premature or newborn baby from the outside. The problem that may occur with such flaps is that the flap is not closed properly but only creates the impression that it is closed. A comparable example is a door that does not shut and therefore unexpectedly opens later on. The risk of an improperly closed incubator hood is that the climate in the interior of the incubator or the thermotherapy apparatus is compromised.

SUMMARY OF THE INVENTION

The object of the present invention is to propose a closing device for a flap on an incubator hood that cannot unexpectedly open.

The object is accomplished according to the present invention by a closing device.

According to one aspect of the invention a closing device for a flap on an incubator hood has a first closing element arranged at the flap and a second closing element arranged at the incubator hood.

According to one aspect of the invention the closing device has a first closing element that is located, by contrast, at the incubator hood and the second closing element at the flap.

Whether the two closing elements are arranged with a first closing element arranged at the flap and a second closing element arranged at the incubator hood or with a first closing element that is located, by contrast, at the incubator hood and the second closing element at the flap is ultimately equivalent for the closing device according to the present invention. The two closing elements cooperate, doing so in such a way that they can be transferred into an open position A or into a closed position B. The flap is open and away from the incubator hood in position A. The flap is closed in position B, i.e., it closes the incubator hood. A roller arranged at the second closing element extends behind the first closing element in this case. The roller is mounted on an axle, which has a clearance in the range of a few mm in the direction perpendicular to a direction in which the axle extends. The second closing element is pre-stressed by means of a spring such that the two closing elements can be brought from position A into position B or conversely, from position B into position A only against the restoring force of the spring. The clearance of the axle, on which the roller is mounted, becomes noticeable as an advantage, because an intermediate position, in which the roller, though touching the first closing element, does not extend behind it, is not assumed between position A and position B, as the design with the clearance of the axle is too labile for this. However, such an intermediate position corresponds precisely to the seemingly closed state of the flap, which can then unexpectedly open.

Advantageous embodiments of the closing device according to the present invention may be provided.

In a preferred embodiment of the closing device, the clearance of the axle is guaranteed by it being mounted in at least one elongated hole.

Furthermore, the clearance of the axle perpendicular to the direction in which it extends is in a range of 1.5 mm to 2.0 mm.

The first closing element is advantageously designed as a projecting bracket, which has an inner arch for receiving the roller of the second closing element, which said roller extends behind it, and the second closing element may in turn be designed as a lever, which is mounted pivotably perpendicular to the axle on which the roller is mounted.

The roller is preferably made of an elastomer, at least on its surface.

In an advantageous embodiment, the axle is mounted via at least one O ring. Good muffling of noises is thus achieved during the opening and closing of the closing device.

The present invention will be explained in greater detail below as an example on the basis of the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
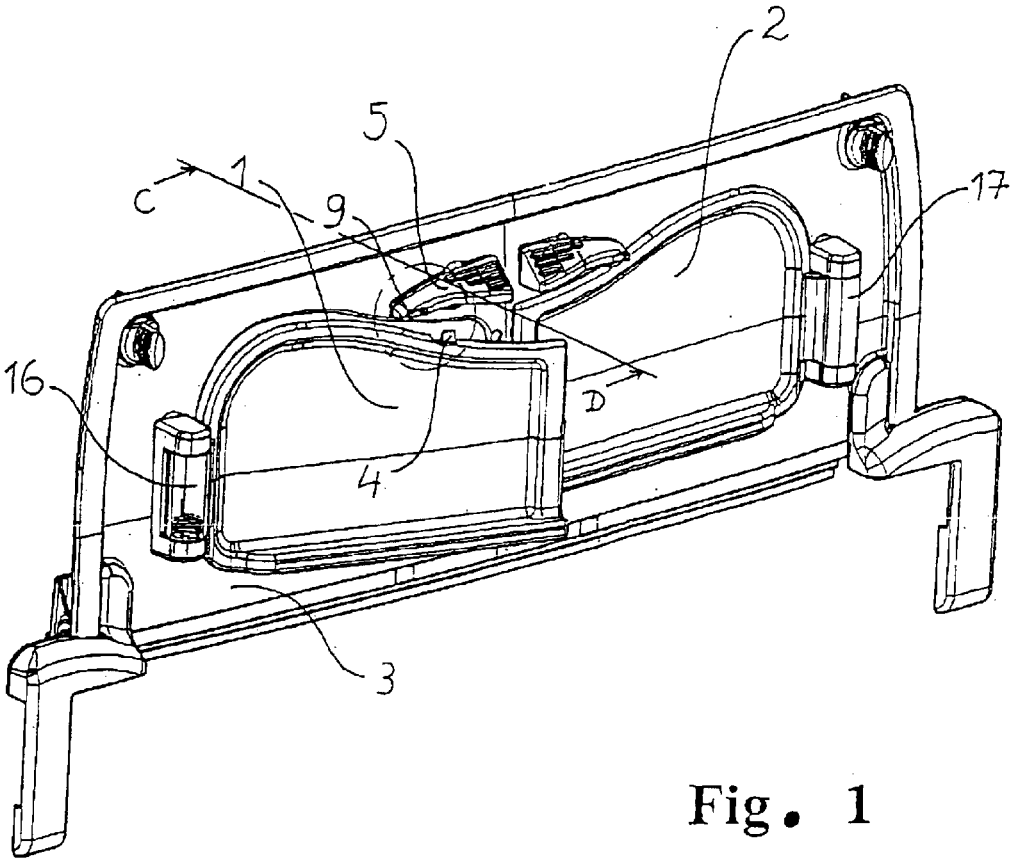
FIG. 1 is a perspective view of an opening on a section of an incubator hood.

FIG. 1 shows a perspective view of an opening 1, 2 on a section of an incubator hood 3. The opening 1, 2 is designed as a double flap and comprises a first wing flap 1 and a second wing flap 2. The wing flaps 1, 2 are arranged on the incubator hood 3 by means of a respective first and second hinge 16, 17. Respective restoring springs, not shown in FIG. 1, which seek to keep the wing flaps 1, 2 in an opened position A, are located at the two hinges 16, 17. The first wing flap 1 is in the opened position A, and the second wing flap 2 is in a closed position B. The closing device according to the present invention will be described based on the example of the first wing flap 1. The first wing flap 1 will hereinafter be called flap 1 for simplicity's sake. The closing device comprises a first closing element 4, which is arranged at the flap 1, and a second closing element 5, which is arranged at the incubator hood 3. The second closing element 5 is designed as a pivotable lever and comprises a roller 9, which is mounted on an axle 8, not shown in FIG. 1. In the closed position B, the second closing element 5 with its roller 9 would extend behind the first closing element 4, which is designed as a bracket with an inner arch 11 receiving the roller 9.

Figure 2:
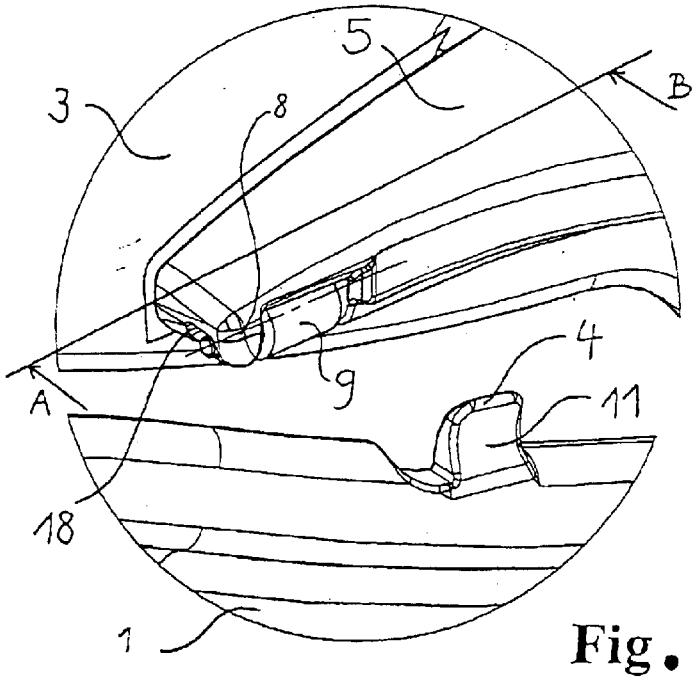
FIG. 2 is an enlarged view of a detail of FIG. 1 concerning the closing device.

FIG. 2 shows an enlarged detail of FIG. 1, namely, the detail of the closing device indicated by a circle drawn in broken line in FIG. 1, with the two closing elements 4, 5. The roller 9 is mounted on an axle 8. The axle 8 extends perpendicular to the closing direction of the closing device, i.e., perpendicular to the direction in which the first closing element 4 is moved toward the second closing element 5 during the transition from the opened position A into the closed position B. This is also the direction in which the flap 1 is moved toward the incubator hood 3 during closing. The axle 8 is mounted in an elongated hole 18 and consequently with a clearance, which is in a range of 1.5 mm to 2.0 mm. The second closing element 5 is pre-stressed such that the two closing elements 4, 5 can be brought from position A into position B or conversely, from position B into position A only against the restoring force of a spring 10 shown in FIG. 3. The first closing element 4 is designed as a bracket, namely, as a projection with a slight inner arch 11, behind which the roller 9 extends in a complementary manner in case of the closed position B.

Figure 3:
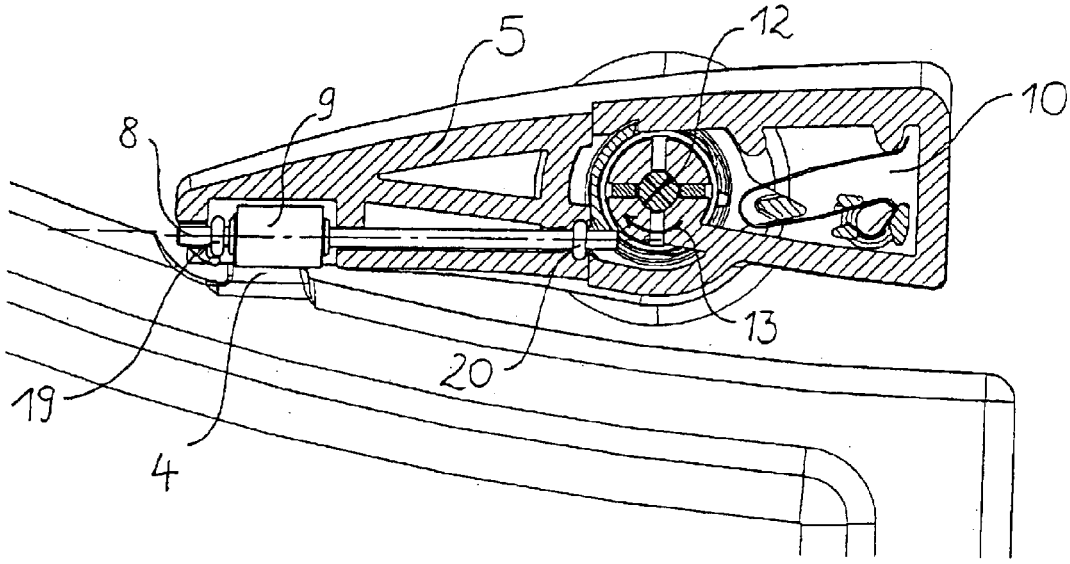
FIG. 3 is a longitudinal sectional view of the closing device from FIG. 2 along line A–B.

FIG. 3 shows a longitudinal section of the closing device from FIG. 2 along line A–B. Identical components are designated by identical reference numbers. The closing elements 4, 5 are in the closed position B in FIG. 3, whereas they are in the opened position A in FIG. 2. In the closed position B, the roller 9 extends behind the first closing element 4 designed as a bracket. The second closing element 5 is designed as a pivotable lever, which is mounted pivotably around the pivot axis 12 protruding perpendicularly into the plane of the drawing. If the two closing elements 4, 5 are brought from position A into position B or conversely, from position B into position A, the roller 9 must be guided each time over the first closing element 4. This is made possible by slightly raising the roller 9 in the course of a slight pivoting movement of the lever 5 in the direction indicated by arrow 13 around the pivot axis 12. A spring 10 pre-stresses the second closing element 5 such that the roller 9 must be guided over the first closing element 4 against the restoring force of spring 10. The roller 9 is mounted on an axle 8, which is in turn mounted on a first and second O-ring 19, 20.

Figure 4A:
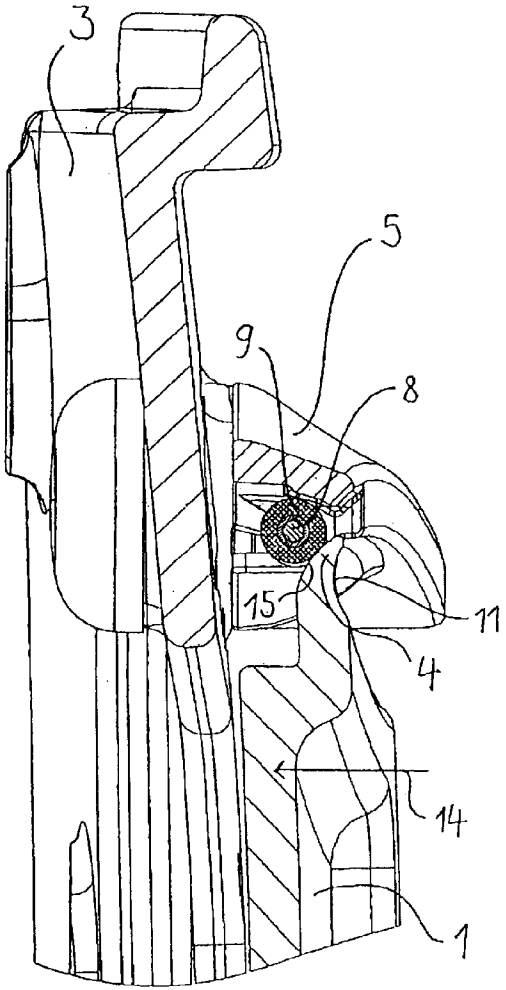
FIG. 4*a* is a cross sectional view of the closing device from FIG. 1 along line C–D, namely, in the first of three phases of the time sequence of the transition from the open position into the closed position.
Figure 4B:
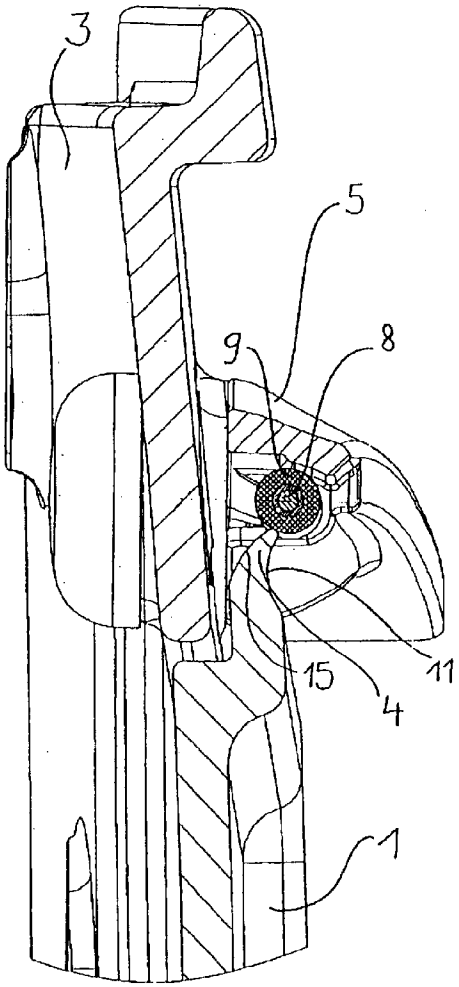
FIG. 4*b* is a cross sectional view of the closing device from FIG. 1 along line C–D, namely, in the second of three phases of the time sequence of the transition from the open position into the closed position.
Figure 4C:
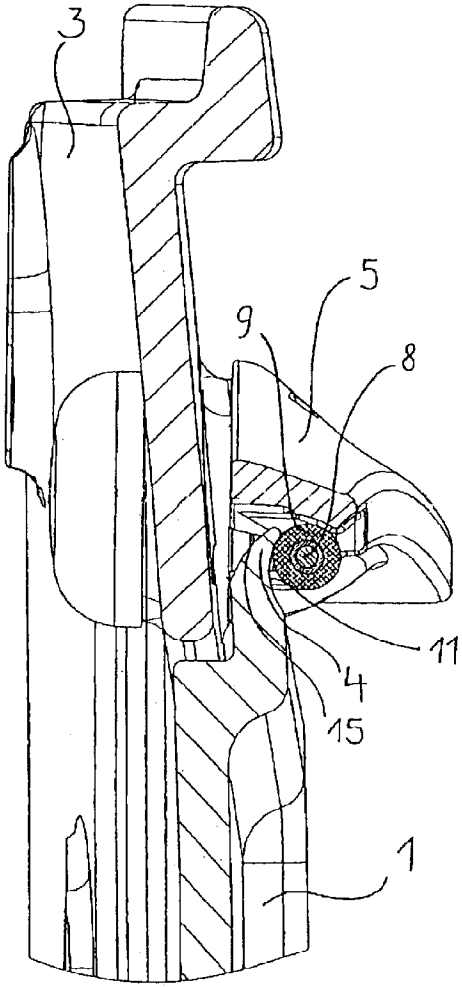
FIG. 4*c* is a cross sectional view of the closing device from FIG. 1 along line C–D, namely, in the third of three phases of the time sequence of the transition from the open position into the closed position.

FIGS. 4*a*, 4*b* and 4*c* show cross sections of the closing device from FIG. 1 along line C–D. Three phases of the time sequence of the process taking place during the transition from the opened position A in FIG. 4*a* into the closed position B in FIG. 4*c* are shown here.

In FIG. 4*a*, the flap 1 has already been moved toward the incubator hood 3 to the extent that even though the two closing elements 4, 5 are still in the opened position A, the outer arch 15 of the first closing element 4, hereinafter called bracket 4, is already in contact with the surface of the roller 9. The flap 1 is now moved farther toward the incubator hood 3 in the direction of arrow 14.

The bracket 4 is already below the roller 9 in FIG. 4*b*, and the upper tip of the bracket 4 touches the lower surface of the roller 9. The axle 8, on which the roller 9 is arranged and pointed perpendicularly into the plane of the drawing, is slightly displaced upward by the bracket 4 against the restoring force of spring 10, which is not shown here. The bracket 4 now transmits the force applied on the flap 1 in the direction of arrow 14, as is shown in FIG. 4*a*.

In FIG. 4*c*, the roller already extends behind the bracket 4. The inner arch 11 of the bracket 4 and the surface of the roller 9 touch each other. Since the upper tip of the bracket 4 now no longer presses the surface of the roller 9 from the bottom, the axle 8 is again pushed back upward against the pretension applied by the spring 10.

While specific embodiments of the invention have been shown and described in detail to illustrate the application of the principles of the invention, it will be understood that the invention may be embodied otherwise without departing from such principles.

What is claimed is:

1. A closing device for a flap on an incubator hood, the closing device comprising:

a first closing element arranged at the flap;

a second closing element arranged at the incubator hood, said second closing element comprising a roller mounted on an axle with a clearance in the range of a few mm in a direction perpendicular to the direction in which the axle extends and spring means for biasing said axle in a direction perpendicular to the direction the axle extends, wherein said first closing element and said second closing element are in functional connection with one another, with said first closing surface having an outer surface so said first closing element and said second closing element can be transferred into an opened position upon said roller acting on said outer surface and with said first closing element having an inner surface receiving said roller to assume a closed position in which the roller extends behind said first closing element, and wherein said second closing element is pre-stressed by said spring means such that the two closing elements can be brought from said opened position into a closed position to set the position of the flap or conversely can be brought from said closed position into said opened position with a pulling force on the flap and/or a force on the roller sufficient to overcome the restoring force of the spring.

2. A closing device in accordance with claim 1, wherein said axle is mounted in at least one elongated hole.

3. A closing device in accordance with claim 1, wherein a clearance of the axle is in a range of 1.5 mm to 2.0 mm.

4. A closing device in accordance with claim 1, wherein said first closing element is designed as a projecting bracket with said inner surface comprising an inner arch for receiving the roller.

5. A closing device in accordance with claim 1, wherein said second closing element is designed as a lever, which is pivotable perpendicular to the axle for biasing said axle in a direction perpendicular to said direction of said axle, and on which said roller is arranged.

6. A closing device in accordance with claim 1, wherein said roller is formed wholly or partially of as elastomer.

7. A closing device in accordance with claim 1, wherein said roller has an elastomer surface.

8. A closing device in accordance with claim 1, wherein the axle is mounted on at least one O-ring.

9. A closing device for a flap on an incubator hood, the closing device comprising:

a first closing element arranged at the incubator hood;

a second closing element arranged at the flap, said second closing element comprising a roller mounted on an axle with a clearance in the range of a few mm in a direction perpendicular to the direction in which the axle extends, wherein said first closing element and said second closing element are in functional connection with one another, so said first closing element and said second closing element can be transferred either into an opened position or into a closed position in which the roller extends behind said first closing element, and wherein said second closing element is pre-stressed by means of a spring such that the two closing elements can be brought from said opened position into a closed position or conversely, from said closed position into said opened position only against the restoring force of the spring, wherein said second closing element is designed as a lever, which pivotable perpendicular to the axle, and on which said roller is arranged.

10. A closing device in accordance with claim 9, wherein said axle is mounted in at least one elongated hole.

11. A closing device in accordance with claim 9, wherein a clearance of the axle is in a range of 1.5 mm to 2.0 mm.

12. A closing device in accordance with claim 9, wherein said first closing element is designed as a projecting bracket with said inner arch for receiving the roller.

13. A closing device in accordance with claim 9, wherein said flap and another flap together cover over at least one opening.

14. A closing device in accordance with claim 9, wherein said roller is formed wholly or partially of an elastomer.

15. A closing device in accordance with claim 9, wherein said roller has an elastomer surface.

16. A closing device in accordance with claim 9, wherein the axle is mounted on at least one O-ring.

17. A thermotherapy apparatus, comprising:

a hood with an opening;

a flap for closing an opening in the hood;

a first closing element arranged at one of said hood and said flap;

a second closing element arranged at the other of said hood and said flap, said second closing element comprising a roller mounted on an axle with a clearance in the range of a few mm in a direction perpendicular to the direction in which the axle extends, wherein said first closing element and said second closing element are in functional connection with one another, so said first closing element and said second closing element can be transferred either into an opened position or into a closed position in which the roller extends behind said first closing element, and wherein said second closing element is pre-stressed by means of a spring such that the two closing elements can be brought from said opened position or into a closed position or conversely, from said closed position into said opened position only against the restoring force of the spring, wherein said first closing element includes a projecting bracket with an inner arch for receiving the roller and an outer surface for interacting with the roller and said second closing element comprises a lever, which is pivotable perpendicular to the axle, and on which said roller is arranged.

18. A closing device in accordance with claim 17, wherein said axle is mounted in at least one elongated bole and a clearance of the axle is in a range of 1.5 mm to 2.0 mm.

19. A closing device in accordance with claim 17, wherein said flap and another flap cover over at least one said opening.

20. A closing device in accordance with claim 17, wherein said roller is formed wholly or partially of an elastomer with at least a roller surface comprising an elastomer.

21. A closing device for a flap on a incubator hood, the closing device comprising:

a fret closing element ranged at the flap;

a second closing element arranged at the incubator hood, said second closing element comprising a roller mounted on an axle with a clearance in the range of a few in a direction perpendicular to the direction in which the axle extends, wherein said first closing element and said second closing element are in functional connection with one another, so said first closing element and said second closing element can be transferred either into an opened position or into a closed position in which the roller extends behind said first closing element, and wherein said second closing element is pre-stressed by means of a spring such that the two closing elements can be brought from said opened position or into a closed position or conversely, from said closed position into said opened position only against the restoring force of the spring, wherein said second closing element is designed as a lever, which is pivotable perpendicular to the axle, and on which said roller is arranged.

* * * * *